US007234607B2

(12) United States Patent
Dunn et al.

(10) Patent No.: US 7,234,607 B2
(45) **Date of Patent: *Jun. 26, 2007**

(54) METHOD OF ADJUSTING VARIABLE FLOW INFANT FEEDING ASSEMBLY

(75) Inventors: Steven B. Dunn, Beverly Hills, CA (US); Tony Hu, Los Angeles, CA (US); Charles P. Davis, Torrance, CA (US); Kevin D. Johnson, Los Angeles, CA (US); Mark Hatherill, Manhattan Beach, CA (US)

(73) Assignee: Munchkin, Inc., North Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/111,374

(22) Filed: Apr. 21, 2005

(65) Prior Publication Data

US 2005/0184022 A1 Aug. 25, 2005

Related U.S. Application Data

(63) Continuation of application No. 10/430,172, filed on May 5, 2003, now Pat. No. 6,883,672.

(60) Provisional application No. 60/377,521, filed on May 3, 2002.

(51) Int. Cl.
*A61J 9/00* (2006.01)
*A61J 11/02* (2006.01)

(52) U.S. Cl. ..... 215/11.5; 215/11.1; 220/714

(58) Field of Classification Search ..... 215/11.1, 215/11.4, 11.5; 220/714
See application file for complete search history.

(56) References Cited

U.S. PATENT DOCUMENTS 2,387,573 A * 10/1945 Ganson ..... 215/11.5
2,434,611 A * 1/1948 Hamiel ..... 215/11.5
2,672,870 A * 3/1954 Alstadt et al. ..... 215/11.5
2,889,064 A * 6/1959 Kurkjian ..... 215/11.1
3,139,064 A * 6/1964 Harle ..... 116/309
3,232,466 A * 2/1966 Turanciol ..... 215/11.5

(Continued)

FOREIGN PATENT DOCUMENTS

EP 0555165 A1 * 8/1993

(Continued)

*Primary Examiner*—Sue A. Weaver
(74) *Attorney, Agent, or Firm*—Knoble Yoshida & Dunleavy, LLC

(57) ABSTRACT

A variable flow infant feeding assembly is designed so that a caregiver can select an optimal feeding flow rate without having to change nipples, as may be desired depending upon the age and appetite of the infant as well as the liquid that is being dispensed. Preferably, the assembly includes a baby bottle and a nipple member that has ventilation structure defined therein for permitting replacement air to enter the baby bottle during feeding. Retention structure such as a threaded ring member is provided for securing the nipple member to the baby bottle. Advantageously, variable restrictor structure is provided, preferably so as to be integral with the ring member, for selectively blocking at least a portion of the ventilation structure. By controlling the size of the opening through which replacement air flows into the baby bottle, the variable restrictor structure permits the feeding flow rate through the nipple member to be adjusted by a caregiver.

4 Claims, 9 Drawing Sheets

U.S. PATENT DOCUMENTS 3,292,809 A * 12/1966 Shomock et al. ..... 215/11.5
3,735,888 A * 5/1973 Jacko ..... 215/11.5
5,101,992 A * 4/1992 Serre ..... 215/11.5
5,117,994 A * 6/1992 Leblanc et al. ..... 215/11.1
5,244,105 A * 9/1993 Serre ..... 215/11.5
6,883,672 B2 * 4/2005 Dunn et al. ..... 215/11.5

FOREIGN PATENT DOCUMENTS

EP 0587505 A1 * 3/1994
FR 2726466 A1 * 5/1996

* cited by examiner

METHOD OF ADJUSTING VARIABLE FLOW INFANT FEEDING ASSEMBLY

This is a continuation of Ser. No. 10/430,172, now U.S. Pat. No. 6,883,672, filed May 5, 2003, which claims priority under 35 U.S.C. §119(e) to Provisional Patent Application Ser. No. 60/377,521, filed on May 3, 2002, the entire disclosure of which is hereby incorporated by reference as if set forth fully herein.

BACKGROUND OF THE INVENTION

1. Field of the Invention

This invention relates to nursing systems for feeding liquids to infants and small children. More specifically, this invention relates to a variable flow infant feeding assembly that is designed so that a caregiver can select an optimal feeding flow rate without having to change nipples, as may be desired depending upon the age and appetite of the infant as well as the liquid that is being dispensed.

2. Description of the Related Technology

Nipple members for baby bottles typically have a circular mounting flange portion and a nursing portion that is designed to fit in an infant's mouth. The two portions are formed together in a single, unitary piece and are fabricated from the same type and grade of flexible material, usually latex, vinyl, silicone or thermoplastic elastomers (TPE's). Nipple member types having different design flow rates and hole configurations for dispensing different types of liquids are widely available. As an infant grows, she or he will learn and expect to drink faster, and nipple manufacturers sell different types of nipple members to accommodate this. Different nipple member types tend to end up mixed in a single container, and a caregiver will have to search each time for the desired type of nipple member, frequently (as any caregiver who has given a midnight feeding will attest) in dim light. Some identifying legend is usually embossed on the rim, but it can be very difficult to read. Some nipples are color-coded, which makes them easier to identify.

Most baby bottles are configured so that a ring member having a large hole defined therein screws on to the baby bottle to seat the mounting flange of the nipple member against the upper lip of the bottle. In order to permit replacement air to enter the baby bottle during feeding, it is typical for nipple members to have one or more ventilation holes defined in the mounting flange. The ring member is typically designed so as not to create an airtight seal with the upper surface of the mounting flange in the area that is close to where the mounting flange transitions into the feeding portion of the nipple member. Accordingly, replacement air will enter the baby bottle through a gap that is defined between the upper surface of the mounting flange of the nipple member and then through the ventilation holes.

U.S. Pat. No. 3,735,888 to Jacko discloses a baby bottle having an adjustable valving structure that is positioned at the bottom end of the baby bottle, opposite from the feeding end, for adjusting the amount of ventilation air that is permitted to enter the baby bottle during feeding, thereby permitting the feeding flow rate to be adjusted. However, this design apparently never achieved widespread commercial acceptance, possibly because of issues of leakage at the bottom of the baby bottle.

Clearly, it would be advantageous to caregivers and product manufacturers alike if a workable system for permitting feeding flow to be varied without changing nipples could be developed. A need exists for an improved infant feeding system that is able to reliably, inexpensively and hygienically provide variable feed flow rate options to caregivers without necessitating changing components such as nipples.

SUMMARY OF THE INVENTION

Accordingly, it is an object of the invention to provide an improved infant feeding system that is able to reliably, inexpensively and hygienically provide variable feed flow rate options to caregivers without necessitating changing components such as nipples.

In order to achieve the above and other objects of the invention, an infant feeding assembly according to a first aspect of the invention includes a baby bottle; a nipple member that has nipple ventilation structure defined therein for permitting replacement air to flow through the nipple member to enter the baby bottle during feeding; retention structure for securing the nipple member to the baby bottle; and variable restrictor structure for selectively blocking at least a portion of said nipple ventilation structure, whereby flow rate through said nipple member may be adjusted by a caregiver.

According to a second aspect of the invention, an infant feeding assembly includes a nipple member that has nipple ventilation structure defined therein for permitting replacement air to enter a baby bottle during feeding; and retention structure for securing the nipple member to a baby bottle, and wherein the retention structure further comprises variable restrictor structure for selectively blocking at least a portion of the nipple ventilation structure, whereby flow rate through the nipple member may be adjusted by a caregiver.

According to a third aspect of the invention, an adjustable infant feeding assembly for use with a baby bottle includes a nipple member; a ring member that is constructed and arranged to be screwed onto a baby bottle in order to secure the nipple member to the baby bottle; and adjustable ventilation structure, defined on at least one of the nipple member and the ring member, for adjusting an amount of ventilation air that will be permitted to flow into a baby bottle when the infant feeding assembly is attached to the baby bottle, and wherein the adjustable ventilation structure is constructed so that adjustment thereof is substantially independent of how tightly the ring member is screwed on to the baby bottle.

According to a fourth aspect of the invention, an adjustable infant feeding assembly for use with a baby bottle includes a nipple member; a ring member that is constructed and arranged to secure the nipple member to a baby bottle; and adjustable ventilation structure, defined on both the nipple member and the ring member, for adjusting an amount of ventilation air that will be permitted to flow into a baby bottle when the infant feeding assembly is attached to the baby bottle.

According to a fifth aspect of the invention, an adjustable infant feeding assembly for use with a baby bottle includes a nipple member; a ring member that is constructed and arranged to secure the nipple member to a baby bottle; and adjustable ventilation structure, defined on at least one of the nipple member and the ring member, for adjusting an amount of ventilation air that will be permitted to flow into a baby bottle when the infant feeding assembly is attached to the baby bottle, and wherein the adjustable ventilation structure is constructed and arranged to be adjusted by changing a relative position of the nipple member with respect to the ring member.

According to a sixth aspect of the invention, an adjustable infant feeding assembly includes a baby bottle; a nipple member, the nipple member having first ventilating structure defined therein; a ring member, the ring member being assembled together with the nipple member and the baby bottle so as to secure the nipple member to the baby bottle, the ring member having second ventilation structure defined therein; and wherein the first and second ventilating structures are in communication with each other so as to define a ventilation space for permitting ventilating air to enter the baby bottle during use.

According to a seventh aspect of the invention, a nipple for use with a baby bottle includes a feeding end having a feeding hole defined therein; a mounting end for mounting the nipple to a baby bottle; first ventilating structure defined in the nipple for facilitating entry of ventilating air to a baby bottle at a first flow rate when the nipple is mounted to a baby bottle; and second ventilating structure, independent of the first ventilating structure, defined in the nipple for facilitating entry of ventilating air into the baby bottle at a second flow rate that is different from the first flow rate.

According to an eighth aspect of the invention, a nipple for use with a baby bottle includes a feeding end having a feeding hole defined therein; a mounting flange for mounting the nipple to a baby bottle; and ventilating structure for communicating with ventilation structure that is defined in a mounting ring that will be used to secure the nipple to a baby bottle.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
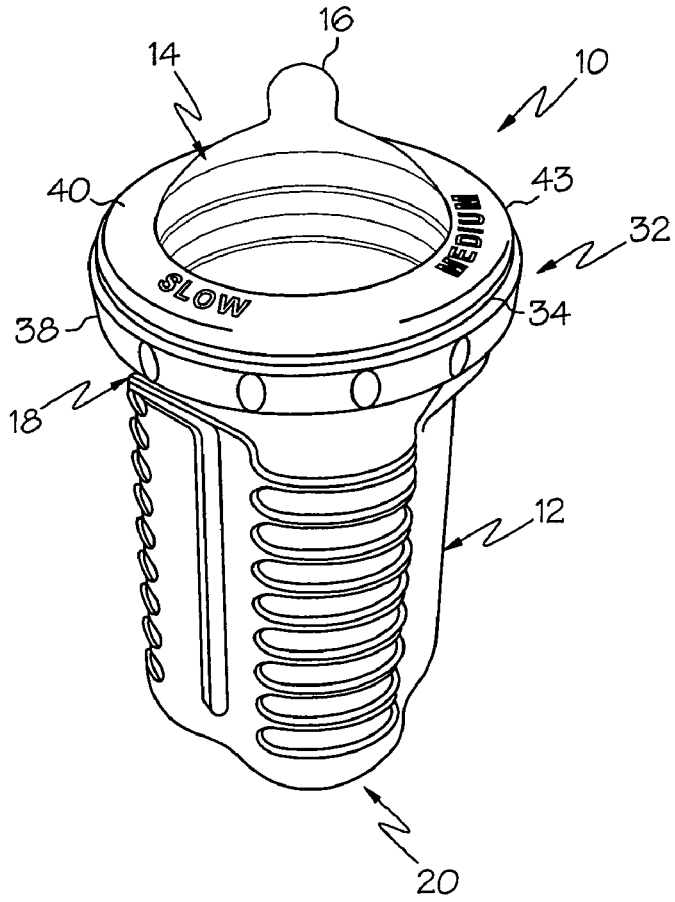
FIG. 1 is a perspective view of a feeding assembly that is constructed according to a preferred embodiment of the invention.

Referring now to the drawings, wherein like reference numerals designate corresponding structure throughout the views, and referring in particular to FIG. 1, an infant feeding assembly 10 that is constructed according to a preferred embodiment of the invention includes a baby bottle 12 and a flexible nipple member 14. Nipple member 14 is preferably fabricated from silicone but could alternatively be fabricated from any known alternative material, such as latex. Nipple member 14 includes a feeding portion 16 that has a pronounced nipple having a hole of predetermined size defined therein, as may be seen in FIG. 1. Preferring briefly to FIG. 4, it will be seen that nipple member 14 further includes a mounting flange portion 22 that is unitary with the feeding portion 16 and that has at least one ventilation recess defined therein in order to permit replacement air to enter the baby bottle 12 during feeding. Most preferably, the at least one ventilation recess is embodied as a first ventilation hole 24 that extends through the entire thickness of mounting flange 22 in a first predetermined radial location on the mounting flange 22, a second ventilation hole 26 located in a second predetermined radial location and a third ventilation hole 28. For purposes that will be described in greater detail below, an indicator 30 is also integrally molded into an upper portion of the nipple member 14. Alternatively, an almost infinite number of different types of ventilation recesses could be provided within the scope and spirit of the invention, including one or more recesses that are defined as notches formed in the outer periphery of the mounting flange, or as one or more slots that are defined in the mounting flange, or as one or more ventilation openings that are provided in the feeding portion 16 rather than in the mounting flange.

Figure 2:
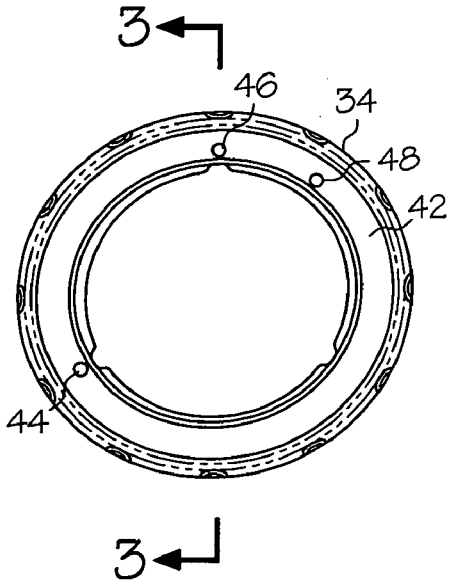
FIG. 2 is a bottom plan view of one component of the feeding assembly that is depicted in FIG. 1.
Figure 3:
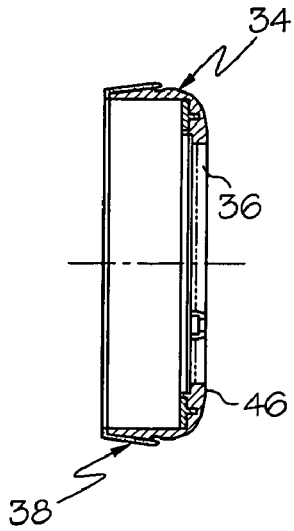
FIG. 3 is a cross-sectional view taken along lines 3—3 in FIG. 2.

Referring now to FIGS. 1-3, it will be seen that the feeding assembly 10 further includes retention structure 32 for securing the nipple member 14 to the baby bottle 12 during use. Preferably, this retention structure is embodied as a ring member 34 that is adapted to be secured to the baby bottle 12, preferably by using mating thread structures, and that has an opening defined therein by an inner rim 36 that is sized to permit the feeding portion 16 of the nipple member 14 to extend therethrough. Ring member 34 has a generally cylindrical outer sidewall portion 38 and a substantially horizontal portion 40 includes the inner rim 36. According to one important aspect of the invention, variable restrictor structure is provided for selectively blocking at least a portion of the ventilation recess that is defined in the nipple member 14. In the preferred embodiment, this variable restrictor structure is located proximate to the feeding end 18 of the baby bottle 12 and therefore so as to be distal from the bottom 20 of the baby bottle 12. The variable restrictor structure is further preferably provided as a plurality of blocking elements that are positioned on an underside 42 of the horizontal portion 40 of the ring member 34. As may be seen in FIG. 2, a first blocking element 44 protrudes axially from the underside 42 at a first radial location, a second blocking element 46 likewise protrudes axially from the underside 42 at a second radial location and a third blocking element 48 similarly protrudes axially from the underside 42 at a third radial location. In the preferred embodiment, ring member 34 is molded in a two-part construction utilizing a first, relatively hard plastic material for the interior threading and for the definition of the inner rim 36 and a second, relatively soft and resilient plastic material for the fabrication of the blocking elements 44, 46, 48. For example, a first, relatively hard plastic material may be a material such as polypropylene, polyethylene or polystyrene, while the second, relatively soft plastic material may be a resilient, rubberlike material such as a firm, resilient elastomeric material such as ethylene vinyl acetate or Krayton™, which is commercially available from Shell Chemical Company. A resilient, rubberlike material is advantageous in that it forms a better seal with respect to a ventilation hole that the particular blocking element may be positioned thereover, as will be described in greater detail below. As may best be seen in FIG. 1, indicia 43, specifically bearing the legends SLOW, MEDIUM, and FAST are molded into an upper surface of the horizontal portion 40 of the ring member 34. In addition, visible notches are defined in the inner rim 36 immediately adjacent to each of the legends in order to provide a visual index for the placement of the indicator 30 for the convenience of the consumer or caregiver in adjusting the variable flowrate of the assembly 10, as will be described below.

Figure 4:
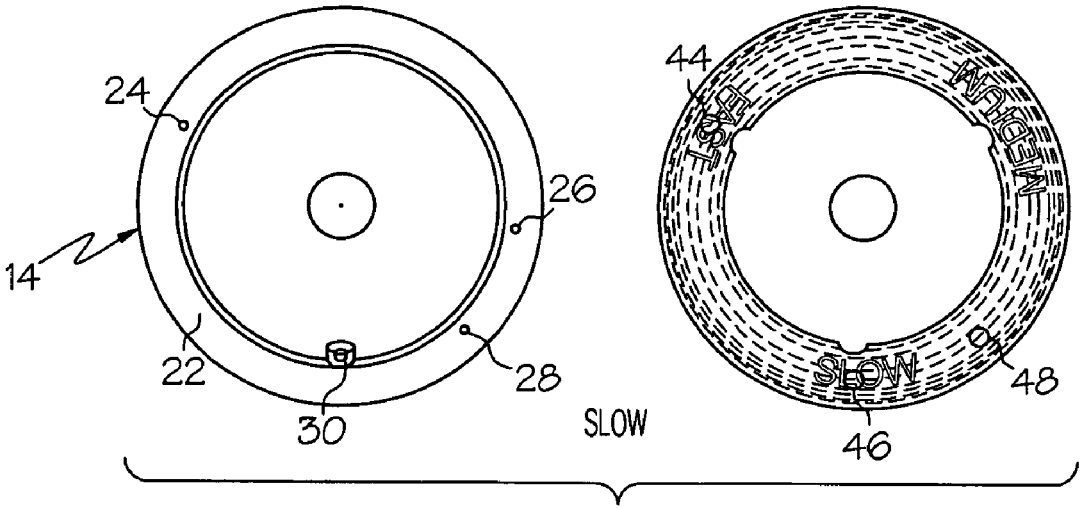
FIG. 4 is a diagrammatical view depicting the feeding assembly according to the preferred embodiment in a first operative position.
Figure 7:
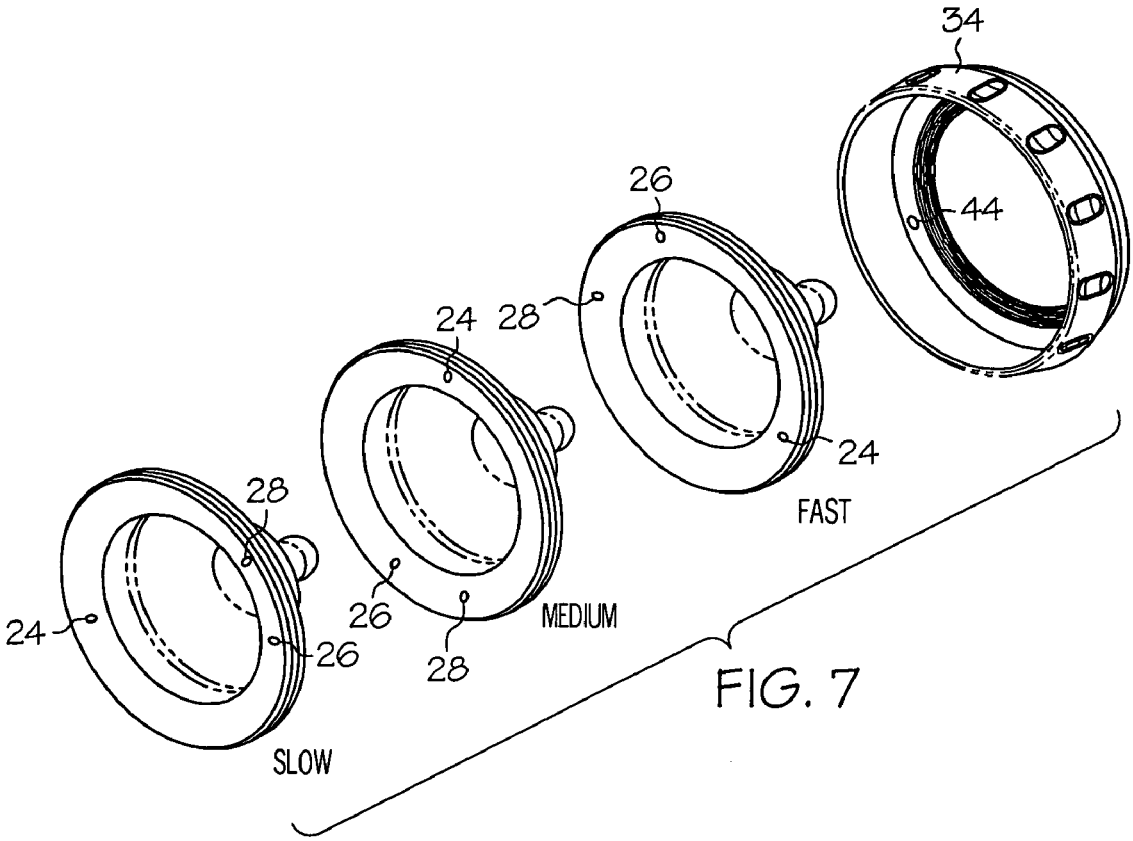
FIG. 7 is a diagrammatical view comparing the three operative positions that are depicted in FIGS. 4, 5 and 6.

In operation, a consumer or caregiver will determine the desired flowrate from the three available options provided in the preferred embodiment, namely a slow flowrate, a medium flowrate or a fast flowrate. Referring to FIGS. 4 and 7, in order to select the slow flowrate the consumer or caregiver will position the nipple member 14 so that it is rotated radially with respect to the ring member 34 to the position that is diagrammatically depicted in FIG. 4. In this position, the indicator 30 that is molded into the nipple member 14 will be positioned adjacent or into the recess that is immediately adjacent to the SLOW legend on the ring member 34. Furthermore, in this position the first ventilation hole 24 is covered and therefore closed or blocked by the first blocking element 44, and the third ventilation hole 28 is similarly closed by the third blocking element 48. With two of the three ventilation holes closed, the amount of ventilation that is permitted during use in this position is significantly limited, creating a relatively slow feeding rate.

Figure 5:
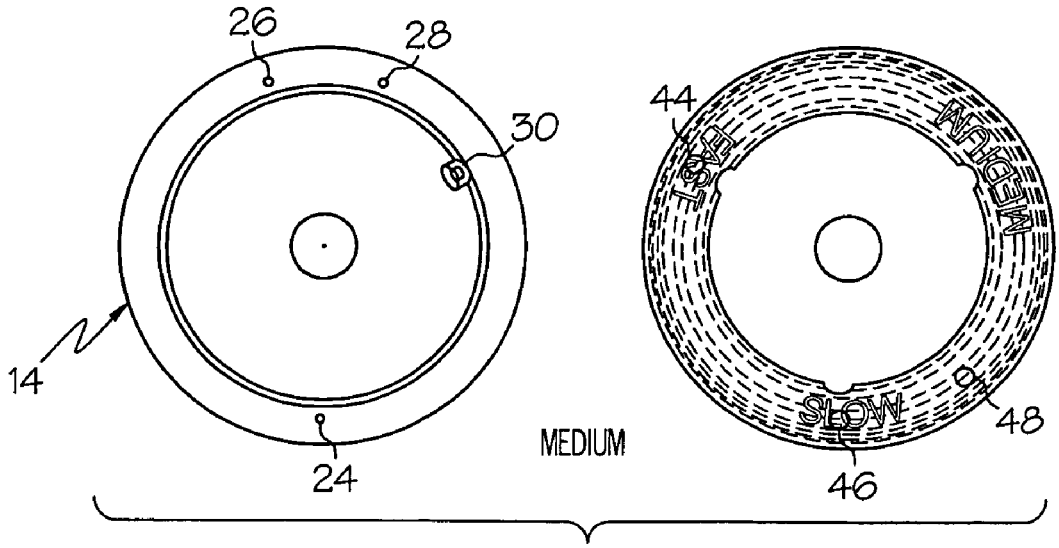
FIG. 5 is a diagrammatical view depicting the feeding assembly in a second operative position.

FIG. 5 and FIG. 7 depict the medium flowrate setting, where the nipple member 14 is rotated and inserted into the ring member 34 such that the indicator 30 will be positioned adjacent or into the recess that is adjacent to the MEDIUM legend. In this position, the first ventilation hole 24 is blocked by the second blocking element 46, but the second and third ventilation holes 26, 28 remain open. This results in a flowrate that is faster than the flowrate in the slow position.

Figure 6:
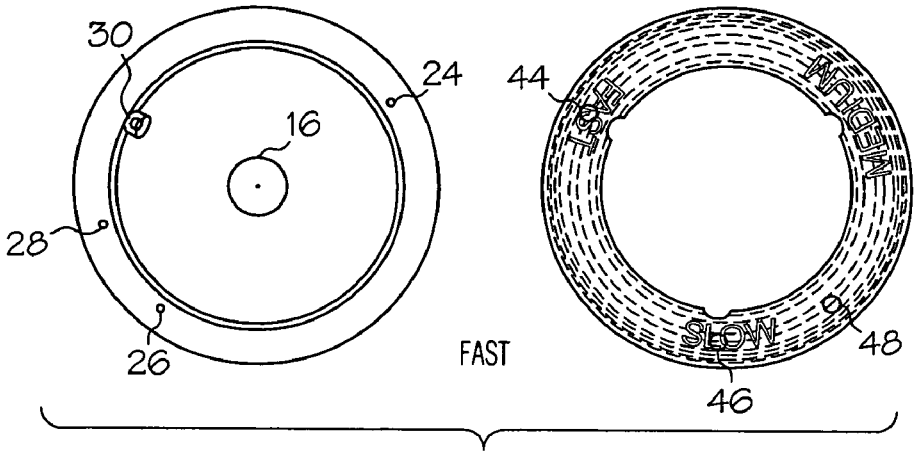
FIG. 6 is a diagrammatical view depicting the feeding assembly in a third operative position.

FIG. 6 and FIG. 7 depict the fast flowrate setting, where the nipple member 14 is rotated and inserted into the ring member 34 such that the indicator 30 will be positioned adjacent or into the recess that is adjacent to the FAST legend. In this position, all of the ventilation holes 24, 26, 28 remain open.

Figure 8:
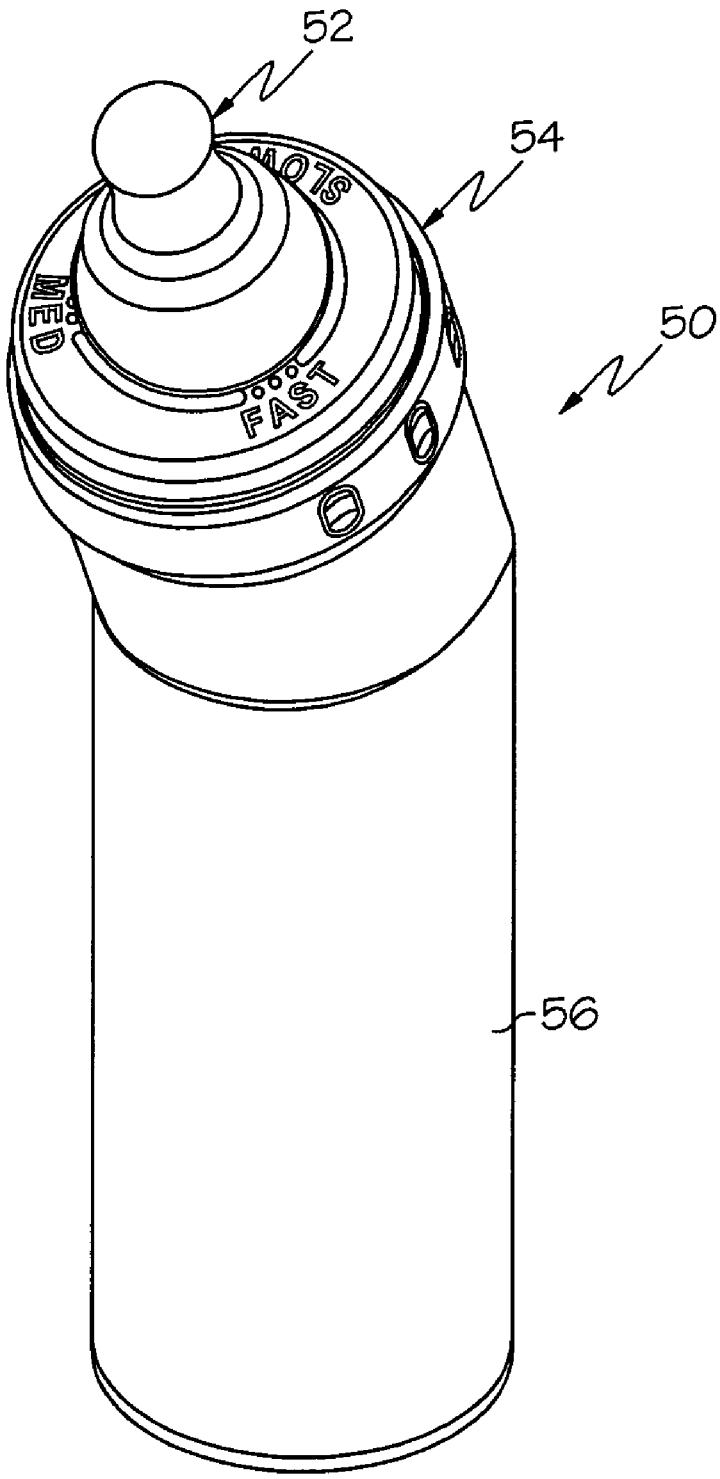
FIG. 8 is a perspective view depicting an infant feeding assembly that is constructed according to a second preferred embodiment of the invention.

An infant feeding assembly 50 that is constructed according to a second preferred embodiment of the invention will now be described with reference to FIGS. 8–20. As shown in FIG. 8, infant feeding assembly 50 includes a nipple member 52 and retention structure for securing the nipple member 52 to a baby bottle 56, the retention structure preferably being embodied as a ring member 54 that is constructed and arranged to screw onto a threaded finish portion of the baby bottle 56.

Figures 9, 10, 11, 12:
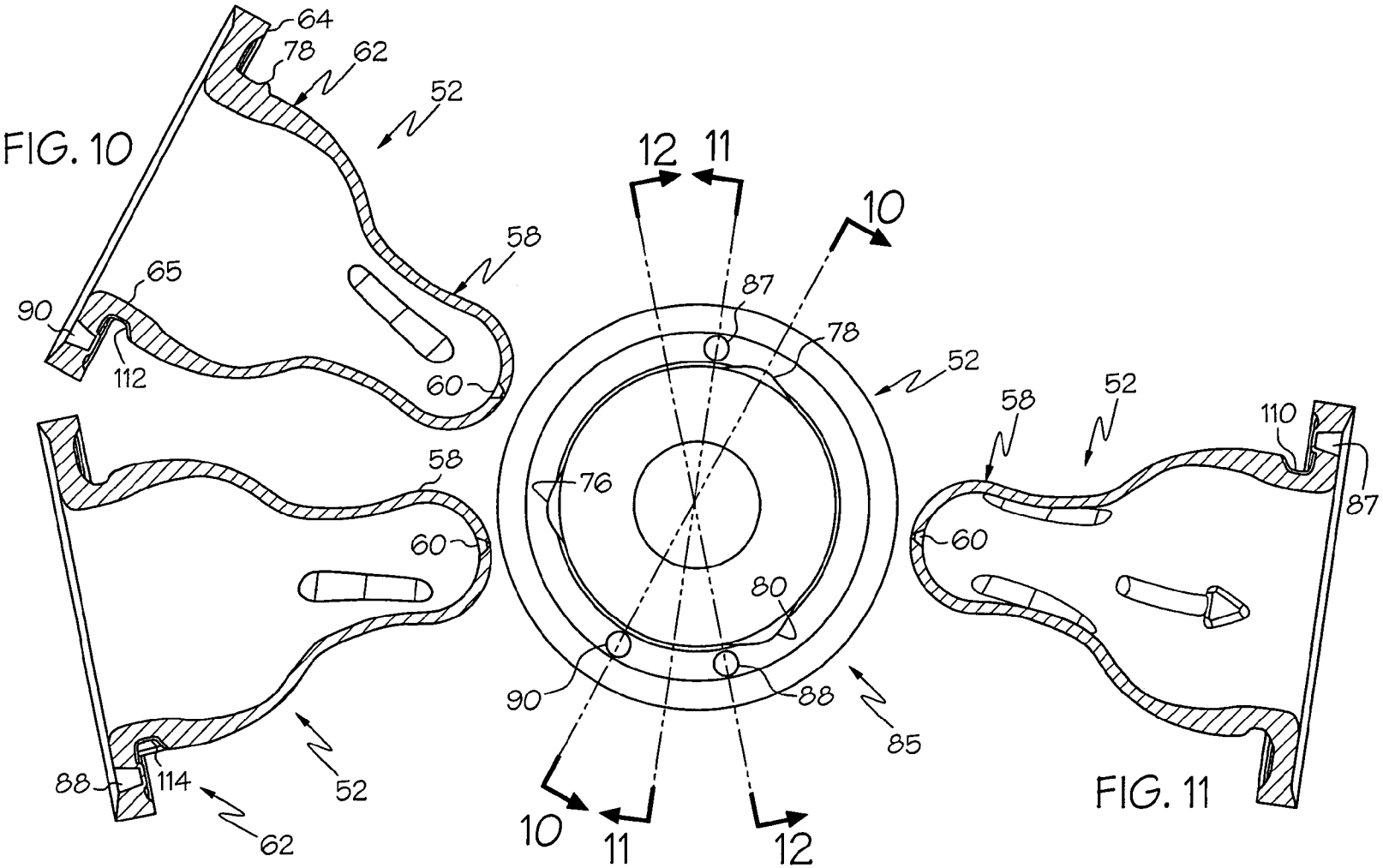
FIG. 9 is a top plan view depicting a nipple member that is constructed according to the second embodiment of the invention.
FIG. 10 is a cross-sectional view taken along lines 10—10 in FIG. 9.
FIG. 11 is a cross-sectional view taken along lines 11—11 in FIG. 9.
FIG. 12 is a cross-sectional view taken along lines 12—12 in FIG. 9.

Referring briefly to FIG. 10, it will be seen that nipple member 52 includes a feeding end 58 that is shaped conventionally so as to fit within the mouth of an infant and that has a feeding hole 60 defined in a distal end thereof through which milk, juice, water or other liquids may be fed to an infant or small child. Nipple member 52 further has a mounting end 62 that is constructed and arranged so as to facilitate mounting of the nipple member 52 to the baby bottle 56 by using the ring member 54. Mounting end 62 is preferably embodied as a mounting flange 64 that is unitary with feeding end 58 and a neck portion 65 that connects the feeding end 58 to the mounting flange 64. Preferably, nipple member 52 is fabricated from a durable, non-toxic, flexible elastomeric material such as silicone. Most preferably, nipple member 52 is fabricated from silicone material having a durometer rating that is within a range of about 40 to about 60 is preferred, with a more preferred range of about 45 to about 55.

Figure 18:
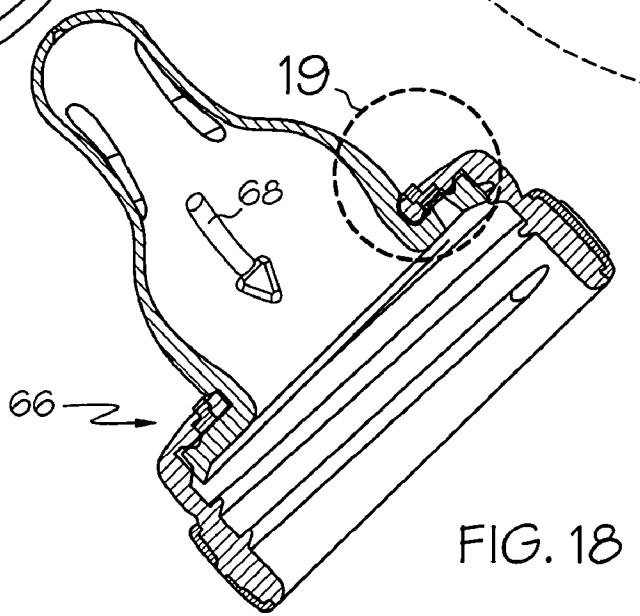
FIG. 18 is a cross-sectional view taken along lines 18—18 in FIG. 17.

According to one important aspect of the invention, adjustable infant feeding system 50 is provided with adjustable ventilation structure 66, shown in FIG. 18, for adjusting an amount of ventilation air that will be permitted to flow into the baby bottle 56 when the infant feeding assembly 50 is attached to the baby bottle 56. In the preferred embodiment, the adjustable ventilation structure 66 is constructed and arranged to be adjusted by changing a position of the nipple member 52 relative to the ring member 54. As is best shown FIG. 18, indicator structure 68 that is preferably styled as a downwardly pointing arrow is provided on the nipple member 52 so as to enable a consumer to determine the rotational position of the nipple member 52 with respect to the ring member 54.

Figure 17:
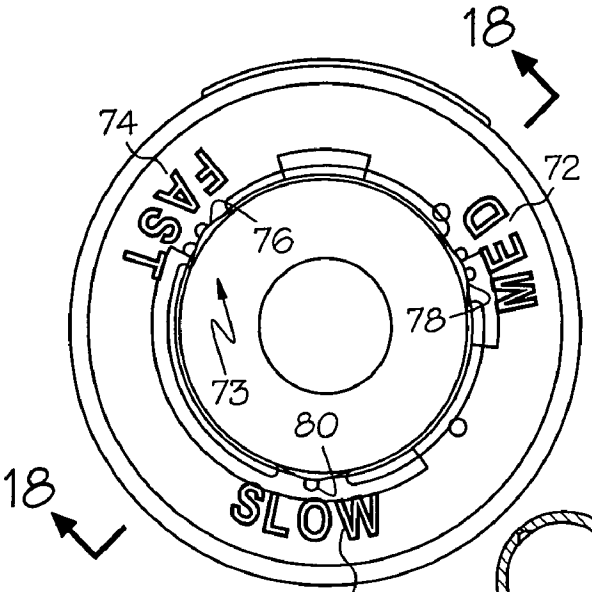
FIG. 17 is a top plan view of a ring member assembled with a nipple member according to the second embodiment of the invention.

To further facilitate this determination, indicia is provided on the ring member 54 that may be referenced against the position of the indicator structure 68 in order to determine the present rotational position of the nipple member 52 with respect to the ring member 54. As is best shown in FIG. 17, this preferably includes first indicia 70 that bears the legend SLOW, second indicia 72 bearing the legend MED, and third indicia 74 bearing the legend FAST. When the indicator structure 68 is in registration with the first indicia 70, nipple member 52 will be in a rotational position relative to ring member 54 at which the adjustable ventilation structure 66 is positioned to ensure relatively slow passage of ventilating air into the baby bottle 56, thereby ensuring a commensurate relatively slow flow of liquid from the baby bottle 56 to the feeding infant. When the indicator structure 68 is in registration with the second indicia 72, adjustable ventilation structure 66 will be positioned to ensure a medium flow of ventilating air into the baby bottle 56, thereby ensuring a medium flow of liquid to the feeding infant. When the indicator structure 68 is in registration with the third indicia 74, nipple member 52 will be in a third rotational position relative to ring member 54 at which the adjustable ventilation structure 66 will be positioned to ensure a relatively swift passage of ventilating air into the baby bottle 56, causing a relatively rapid flow of liquid to be available to the feeding infant.

The adjustable ventilation structure 66 is advantageously constructed so that the amount of ventilation provided is substantially independent of how tightly the ring member 54 is seated onto the baby bottle 56. To ensure this, additional structure (not shown) may be provided to stop the ring member 54 from being overtightened onto the baby bottle 56.

In order to assist the consumer or caregiver to correctly position the nipple member 52 relative to the ring member 54, indexing structure 73 is provided that in the preferred embodiment includes a first radial projection 76 that extends radially outwardly from the neck portion 65 of the nipple member 52, and identically shaped radial projections 78, 80 that are evenly spaced about the periphery of the neck portion 65 with respect to first radial projection 76, 50 that the three projections are separated from each other in orientation by about 120 degrees. As may best be seen in FIG. 20, first, second and third recesses 82, 84, 86 are defined in an inwardly extending upper lip of the ring member 54 and are shaped so as to be complementary to the shape of the radial projections 76, 78, 80. The presence of the projections 76, 78, 80 and the mating recesses 82, 84, 86 prevent the nipple member 52 from being operatively seated within the ring member 54 in any rotational position other than the three rotational positions described above corresponding to the three possible settings of the adjustable ventilating structure 66. In addition, the indexing structure prevents a user from inadvertently causing relative rotation to occur when the ring member 54 is tightened onto the baby bottle 56.

Figure 14:
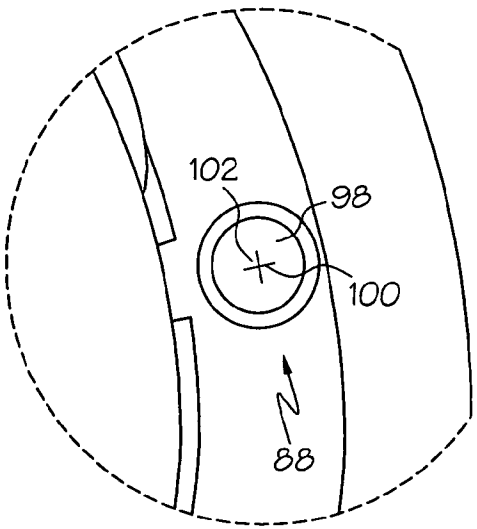
FIG. 14 is a magnified view showing the area that is depicted by numeral 14 in FIG. 13.
Figure 15:
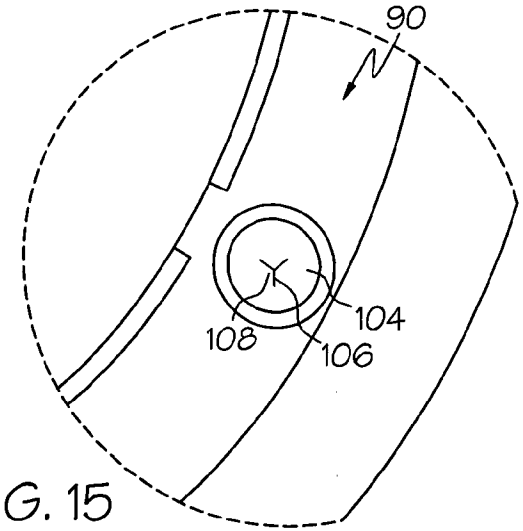
FIG. 15 is a magnified view showing the area that is depicted by numeral 15 in FIG. 13.
Figure 13:
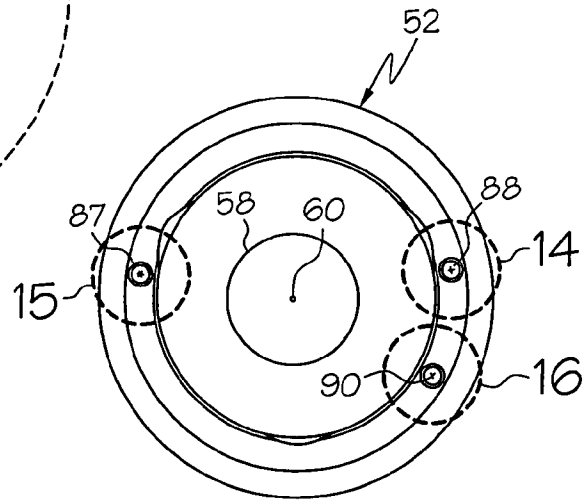
FIG. 13 is a top plan view depicting the nipple member that is shown in FIG. 9.
Figure 16:
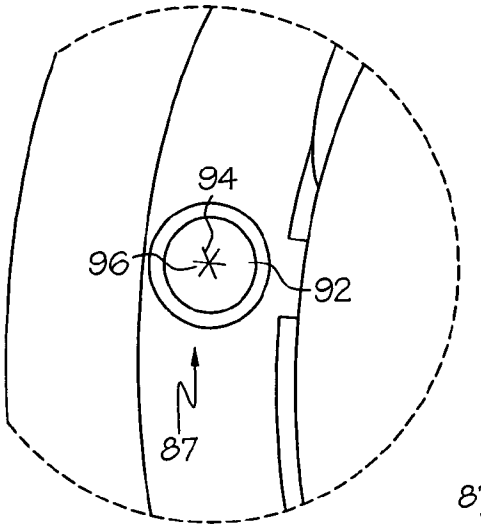
FIG. 16 is a magnified view showing the area that is depicted by numeral 16 in FIG. 13.

Referring to FIGS. 9-12, it will be seen that the adjustable ventilating structure 66 includes first ventilating structure 85 that is provided on the nipple member 52 and second ventilating structure 116, described in greater detail below, provided on the ring member 54 that selectively communicates with the first ventilating structure 85 in order to control ventilation during operation of the infant feeding assembly 50. As is best shown in FIG. 9, first ventilating structure 85 preferably include first, second and third ventilation holes 87, 88, 90, each of which is defined within and extends through the mounting flange 64. As is described in greater detail below, first ventilation hole 87 is utilized to provide ventilation to the baby bottle 56 when the adjustable venting structure 66 is in the FAST position, while the second and third ventilation holes 88, 90 are utilized, respectively, when the adjustable venting structure 66 is in the MED and SLOW positions. Referring now to FIGS. 13-16, structure is provided on each of the ventilation holes 87, 88, 90 to both seal against passage of fluid from the baby bottle 56 and to regulate the rate of airflow through each of the respective ventilation holes. More specifically, referring to FIG. 16, it will be seen that the first ventilation hole 87 is covered at its upper end by a membrane 92 that has three intersecting slits 94 defined therein to form what could be described as a starburst pattern. The slits define six cantilevered flaps 96 that extend outwardly over the upper end of the first ventilation hole 87. By controlling the size, shape and thickness of the flaps 96 and the durometer hardness of the material from which the nipple member 52 is fabricated, the segmented membrane 92 may be controlled to precisely regulate resistance that is experienced by fluids, specifically both air and liquid, as it is induced to travel through the first ventilation hole 87. Similarly, as is shown in FIG. 14, a membrane 98 located at the uppermost end of the second ventilation hole 88 is segmented by a pair of slits 100 into four cantilevered flaps 102. As may be seen in FIG. 15, a membrane 104 is positioned at the uppermost end of the third ventilation hole 90 that is segmented into three cantilevered flaps 108 by a trio of slits 106.

All three of the membranes 92, 98, 104 are engineered to intercept the passage of liquids from the baby bottle 56 in order to prevent leakage during use. In addition, the membranes 92, 98,104 are respectively calibrated so as to permit a relatively rapid flow of ventilating air, a medium flow of ventilating air and a relatively sparse flow of ventilating air to the respective ventilating holes 87, 88, 90. In the preferred embodiment, membranes 92, 98,104 have approximately the same thickness and are fabricated from the same material, and the differential in calibration is achieved primarily by the different segmentation patterns that are defined on the membranes 92, 98,104. Specifically, it has been found that by increasing the number of slits and the corresponding number of cantilevered flaps, resistance to airflow through the segmented membrane will be reduced. Consequently, all other factors being equal, a resistance through the first membrane 92 will be less than a resistance through the second membrane 98, which in turn will be less than the resistance through the third membrane 104. The flowing is a table depicting test results depicting mass flow of water in grams for an elapsed time of sixty seconds, under a constant pressure equal to three inches of Hg (data in this table includes the weight of the container, which is 17.8 grams):

| Slow (90) | Medium (88) | Fast (87) |
|---|---|---|
| 40.94 | 56.81 | 61.96 |
| 39.14 | 54.8 | 61.04 |
| 38.74 | 56.06 | 61.16 |
| 35.52 | 54.9 | 63.08 |
| 40.54 | 56.1 | 60.54 |
| 37.9 | 45.18 | 59.98 |
| 38.24 | 51.26 | 62.42 |
| 36.96 | 40.22 | 66.64 |
| 29.82 | 50.72 | 60.94 |
| 33.06 | 50.4 | 62.04 |
| 37.086 | 51.645 | 61.98 |

The first ventilating structure 85 that is defined in the nipple member 52 further preferably includes first, second and third ventilating channels 110,112,114 that are defined in the neck portion 65 of the nipple member 52. Each ventilating channel 110, 112, 114 is preferably located immediately radially inwardly from a respective ventilating hole 87, 90, 88 for purposes that will be described in greater detail below.

Figure 19:
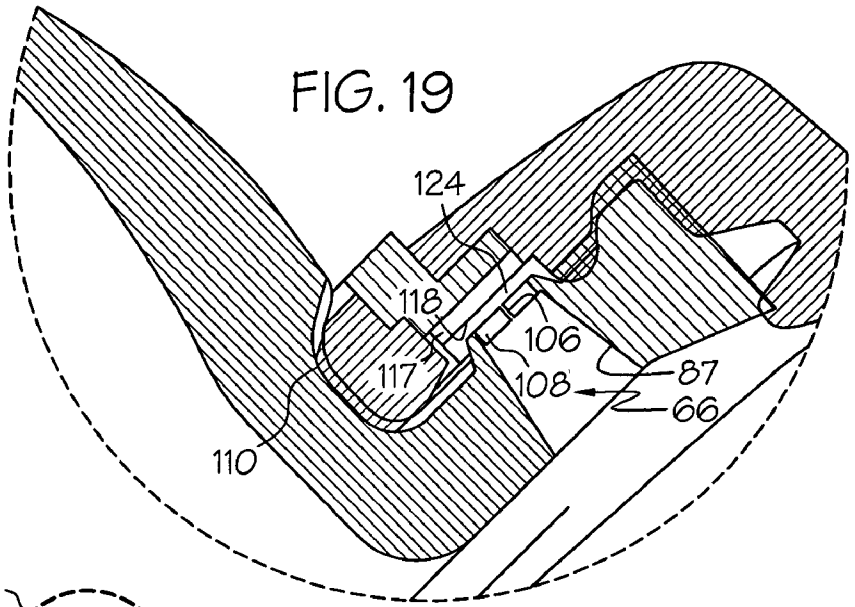
FIG. 19 is a magnified view of the area that is depicted by numeral 19 in FIG. 18.
Figure 20:
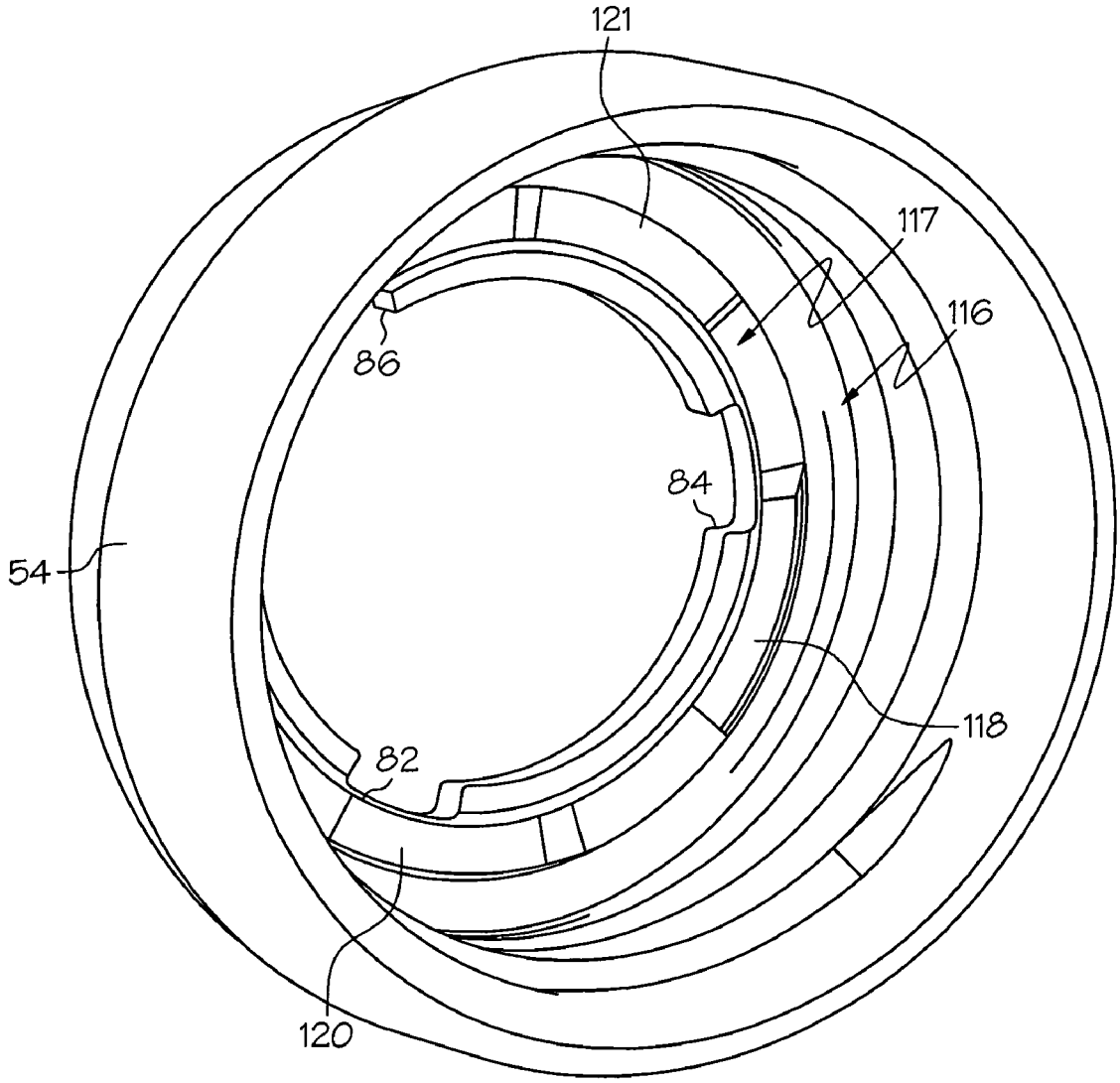
FIG. 20 is a perspective view showing an underside of a ring member constructed according to the second embodiment of the invention.
Figure 21:
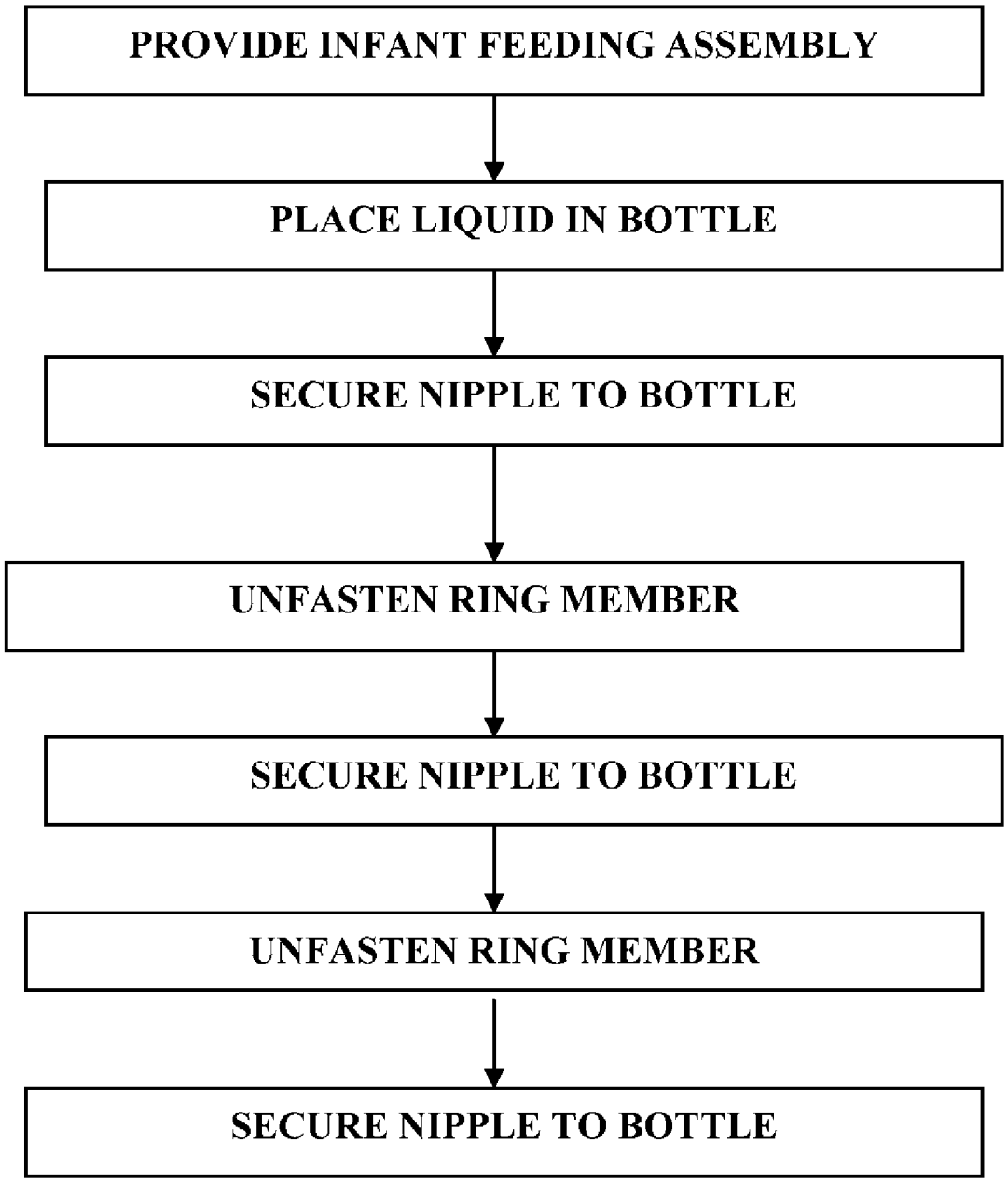
FIG. 21 is a flowchart depicting a method that is performed according to a preferred embodiment of the invention.

Looking now to FIG. 20, it will be seen that the second ventilating structure 116 that is provided on the ring member 54 preferably includes a contoured elastomeric gasket 117 that is inset within a downwardly extending inner surface of the ring member 54. Gasket 117 is annular in shape and preferably has defined therein about its periphery first, second and third recesses 118, 120, 122 that will together with the mounting flange 64 of the nipple member 52 define ventilation chambers 124 when the nipple member 52 is seated within the ring member 54 and assembled onto the baby bottle 56. As is best shown in FIG. 19, which depicts a ventilation chamber 124 that is defined by the first recess 118, the ventilation chamber 124 is in communication with both the first ventilating hole 87 and a passage that is defined by the ventilating channel 110 between the neck portion 65 of the nipple member 52 and the ring member 54. When the nipple member 52 is positioned with respect to the ring member 54 so that the indicator structure 68 is aligned with the FAST indicia 74, the first ventilating hole 87 will be positioned so that it is in communication, subject to the regulation that is provided by the segmented membrane 92, with the ventilation chamber 124 that is defined between the mounting flange 64 of the nipple member 52 and the gasket 117 in the area of the first recess 118, as shown in FIG. 19. In this position, the second and third ventilating holes 88, 90 will bear directly against the surface of the gasket 117, thereby preventing passage of air through the ventilating holes 88, 90.

When the nipple member 52 is positioned with respect to the ring member 54 so that the indicator structure 68 is aligned with the MED indicia 72, the first and third ventilating holes 87, 90 will bear directly against the surface of the gasket 117, thereby preventing airflow through those ventilating holes 87, 90. However, the second ventilating hole 88 will be in communication with a ventilation chamber 124 that is defined between the gasket 117 and the mounting flange 64 by the second recess 120. In this position, ventilating air will be permitted to pass through the second ventilating hole subject to the regulation that is provided by the segmented membrane 98.

When the nipple member 52 is positioned with respect to the ring member 54 so that the indicator structure 68 is aligned with the SLOW indicia 70, the first and second ventilating holes 87, 88 will bear against the surface of the gasket 117, effectively sealing them from the possibility of airflow therethrough. However, subject to the regulation provided by segmented membrane 104, the third ventilating hole 90 will be in communication with a ventilation chamber 124 that is defined between the gasket 117 and the mounting flange 64 by the third recess 121.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of setting a flowrate of an infant feeding assembly, comprising steps of:

providing an infant feeding assembly comprising a baby bottle, a nipple member having a feeding end and nipple member ventilation structure and a ring member that is adapted to be secured onto the baby bottle and having ring member ventilation structure;

placing a liquid into said baby bottle;

securing said nipple member to said baby bottle by using said ring member so that said nipple member and said ring member are oriented with respect to each other, whereby said nipple member ventilation structure and said ring member ventilation structure communicate in a first flowrate position having predetermined flowrate characteristics;

unfastening said ring member from said baby bottle and removing said nipple member; and securing a nipple member to said baby bottle by using said ring member so that said nipple member and said ring member are oriented with respect to each other, whereby said nipple member ventilation structure and said ring member ventilation structure communicate in a second flowrate position having predetermined flowrate characteristics that are different than said flowrate characteristics of said first flowrate position.

2. A method according to claim 1, further comprising steps of:

unfastening said ring member from said baby bottle and removing said nipple member; and securing a nipple member to said baby bottle by using said ring member so that said nipple member and said ring member are oriented with respect to each other, whereby said nipple member ventilation structure and said ring member ventilation structure communicate in a third flowrate position having predetermined flowrate characteristics that are different than said flowrate characteristics of said first flowrate position and of said second flowrate position.

3. A method according to claim 1, wherein said step of securing said nipple member to said baby bottle by using said ring member so that said nipple member and said ring member are oriented with respect to each other comprises orienting said nipple member and said ring member in a second predetermined relative rotational position with respect to each other that corresponds to said second flowrate position.

4. A method according to claim 2, wherein said step of securing said nipple member to said baby bottle by using said ring member so that said nipple member and said ring member are oriented with respect to each other comprises orienting said nipple member and said ring member in a third predetermined relative rotational position with respect to each other that corresponds to said third flowrate position.

* * * * *